US006149205A

United States Patent [19]

Attia et al.

[11] Patent Number: 6,149,205

[45] Date of Patent: Nov. 21, 2000

[54] TWO LAYER MAILER ENVELOPE FOR BROCHURE

[75] Inventors: Omar S. Attia, Lakeview; Blaine Jackson, East Aurora; Andre Saint, Tonawaunda; Brett Ulrich, South Wales, all of N.Y.

[73] Assignee: Avery Dennison Corporation, Pasadena, Calif.

[21] Appl. No.: 09/535,450

[22] Filed: Mar. 24, 2000

[51] Int. Cl.[7] ..... B42D 15/00

[52] U.S. Cl. ..... 283/116; 281/38; 462/64; 283/56; 229/68.1

[58] Field of Search ..... 283/116, 117, 283/101; 281/56, 38; 229/68.1, 307, 313; 462/64, 65

[56] References Cited

U.S. PATENT DOCUMENTS 3,941,309 3/1976 Gendron ..... 283/116 X
4,084,696 4/1978 Katz ..... 283/56 X
4,313,557 2/1982 Foffel ..... 283/116 X
5,590,912 1/1997 Stevens ..... 283/116
5,913,725 6/1999 Goldring ..... 283/116 X

*Primary Examiner*—Willmond Fridie, Jr.
*Attorney, Agent, or Firm*—Oppenheimer Wolff & Donnelly LLP

[57] ABSTRACT

An envelope sheet assembly for securing into a brochure or binder includes two sheets overlying one another so that the assembly is of uniform thickness to facilitate printing thereon. The envelope sheet assembly is preferably 8½ inches by 11 inches in size, and the envelope is preferably 11 inches by 4½ inches. Permanent pressure sensitive adhesive is employed to form the envelope and is applied to the sealing flap, with a removable strip to protect the adhesive coated flap. Perforations permit easy removal of the envelope from the assembly.

20 Claims, 3 Drawing Sheets

TWO LAYER MAILER ENVELOPE FOR BROCHURE

FIELD OF THE INVENTION

This invention relates to mailer envelope sheets for inclusion in a brochure, catalog, booklet, binder or the like.

BACKGROUND OF THE INVENTION

It has previously been proposed to include return mailer envelopes in brochures, see R. E. Katz U.S. Pat. No. 4,084,696 granted Apr. 18, 1978. However, the '696 envelope sheet has certain drawbacks. For example, it has an envelope portion which is double thickness, while the remainder of the sheet is a single thickness of paper. For stacking and printing on sheets of paper, it is important that the paper be of uniform thickness to provide regular stacking and to avoid jamming of the copier. In addition, the '696 patent has exposed adhesive which could be activated under high humidity or damp conditions. With exposed activated adhesive, sheets may stick together and laser or ink jet printers may jam or become contaminated.

SUMMARY OF THE INVENTION

Accordingly, it is a principal object of the present invention to provide an envelope sheet assembly for securing in a brochure, magazine, or the like, which has no exposed adhesive, and which will readily feed through high speed printers without jamming or contamination.

In one illustrative embodiment of the invention, the envelope sheet assembly is formed of two layers and is of substantially uniform thickness for high speed printing, includes an envelope with a length greater than 8½ inches and a width greater than 4 inches for conveniently receiving a standard 8½×11 inches or an A-4 sheet folded three times, a pressure sensitive strip forming the closure flap of the envelope, with the pressure sensitive adhesive being covered by a removable strip forming part of said assembly, and with the sheet assembly being provided with perforations for permitting easy removal of said envelope from the rest of said sheet assembly. It is noted that the dimensions given above are for standard size 8½ inches by 11 inches, or A-4, sheets included in brochures, and for brochures or the like having different dimensions, the two layer envelope assembly would be correspondingly modified in its dimensions.

The sheet assembly may also include one or more of the following additional features: (1) an envelope which is approximately 11 inches long; (2) the envelopes may be approximately 4 inches to 5 inches in height; (3) an envelope which is sealed at the bottom and two sides with permanent glue or adhesive, preferably permanent pressure sensitive adhesive; (4) the individual sheets making up the two layer sheet assembly may be formed of fairly lightweight paper so that the sheets may be semi-translucent or semi-transparent; and (5) the inside surfaces of the envelope may be provided with a printed pattern to preclude reading enclosures through the envelope.

Other objects, features and advantages of the invention will become apparent from a consideration of the following detailed description and from the accompanying drawings.

DETAILED DESCRIPTION OF PREFERRED EMBODIMENTS

Figure 1:
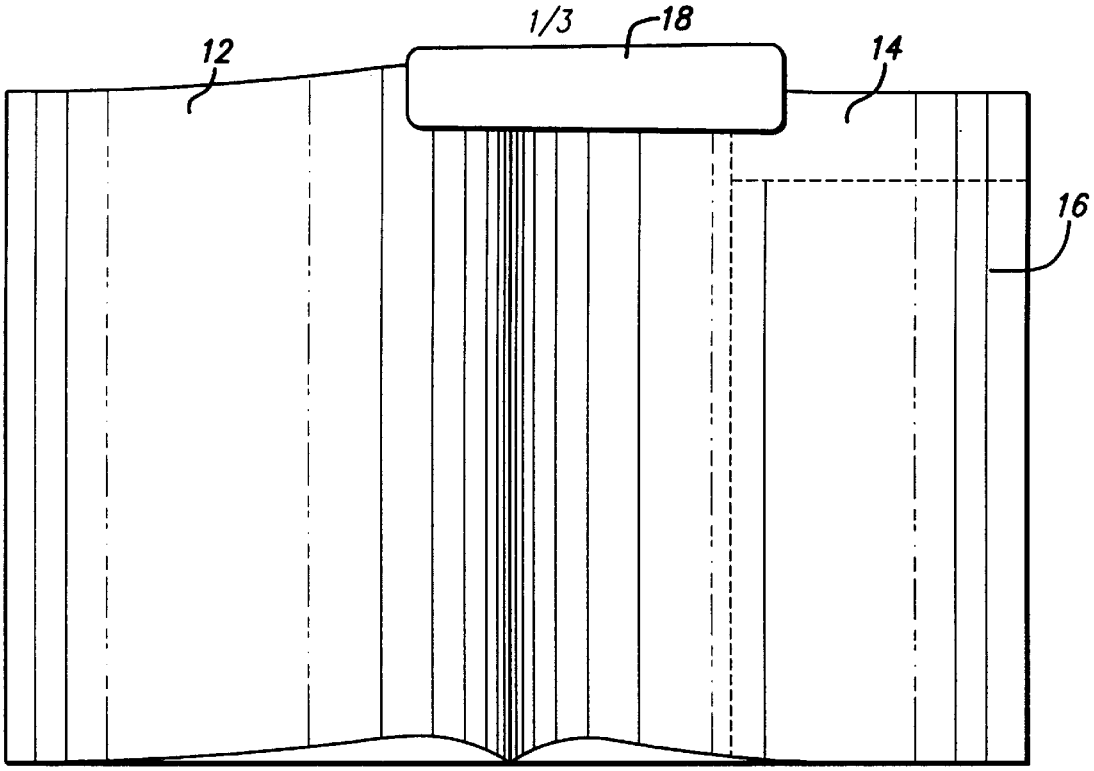
FIG. 1 shows a brochure which includes a two layer envelope sheet assembly bound into the brochure, and illustrating the principles of the invention, and showing the rear side of the envelope.

Referring more particularly to the drawings, FIG. 1 shows a brochure or binder 12 including a two layer envelope sheet assembly 14. In FIG. 1, the back of the envelope 16 is shown.

Figure 2:
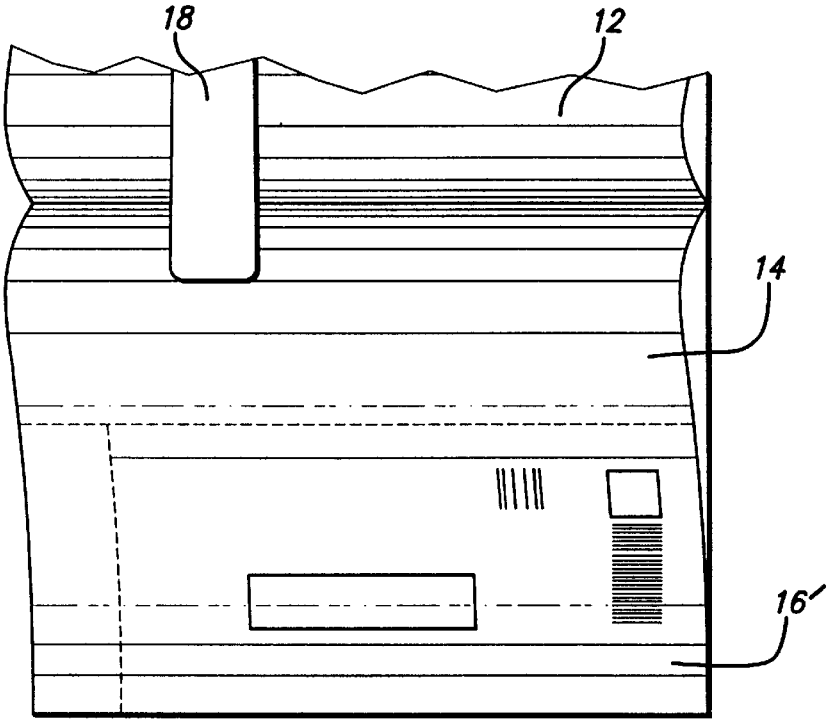
FIG. 2 is a showing of the front side of the envelope forming part of the two layer sheet assembly bound into the brochure.

In FIG. 2 the front 16' of the envelope is shown, with the two layer envelope assembly 14 being turned as one page in the brochure or binder 12.

In both FIGS. 1 and 2, a stapler 18 is shown, to hold the brochure open.

Figure 3:
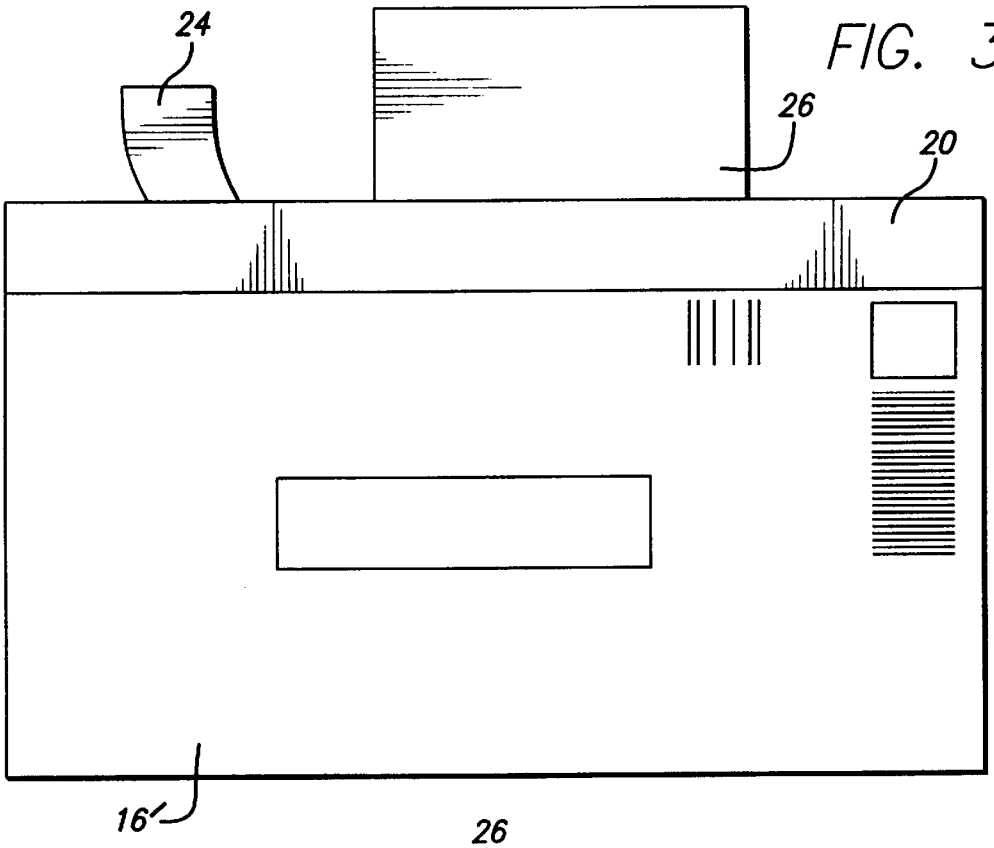
FIG. 3 shows the front of the envelope following detachment from the rest of the two layer sheet assembly.

Turning now to FIG. 3, the front 16' of the envelope is shown. At the top of the envelope is the sealing flap 20. The rear of the sealing flap 20 is coated with pressure sensitive adhesive, in the area designated by the reference numeral 22 in FIG. 4. The strip of paper 24, shown partially peeled back in FIGS. 3 and 4, protects the pressure sensitive adhesive, and is peeled off when the user seals the envelope. In practice, a thin release layer, for example silicone, is provided between the strip 24 and the pressure sensitive adhesive to permit easy removal of the strip.

Figure 4:
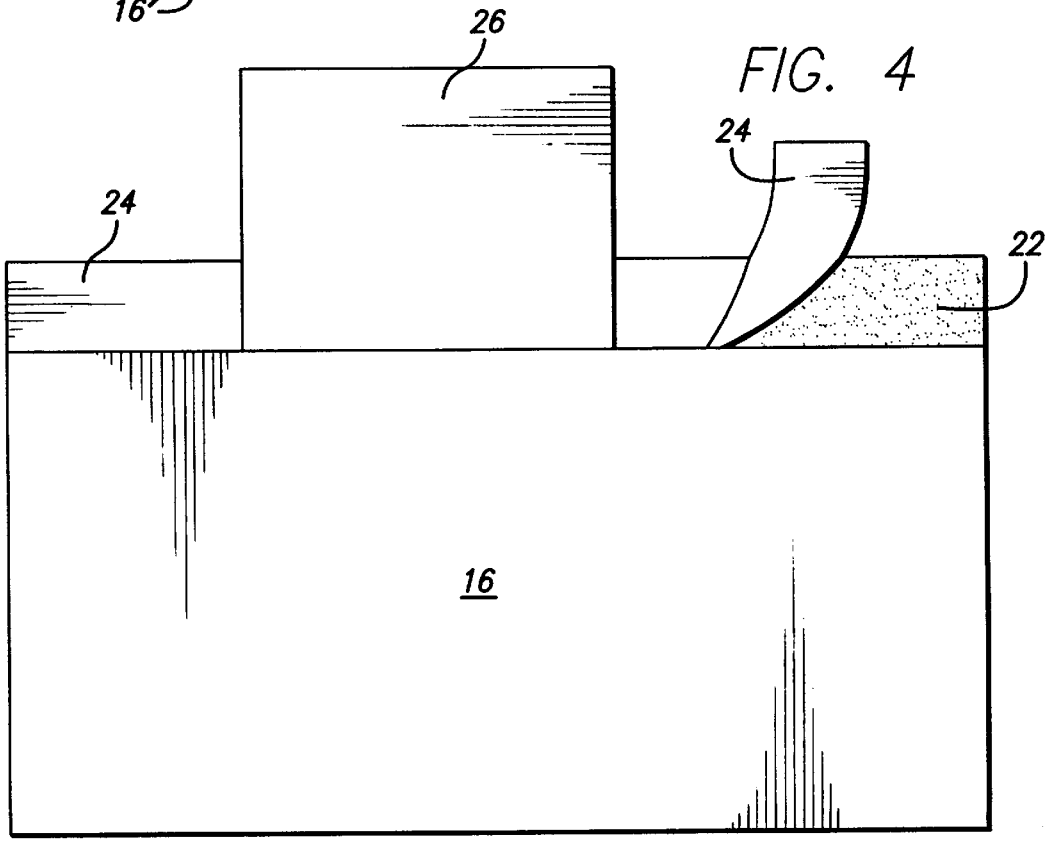
FIG. 4 shows the back of the envelope of FIG. 3.

A folded sheet of paper 26 is shown partially extending into the envelope 16 in FIGS. 3 and 4 to show the location of the opening of the envelope.

Consideration will now be given to FIG. 5 in which the complete two layer envelope assembly 14 is shown, with the back of the envelope 16 being visible. Perforations 30 through both layers of the two layer sheet assembly permit easy removal of the envelope 16 from the remainder 32 of the two layer sheet assembly 14.

Figure 5:
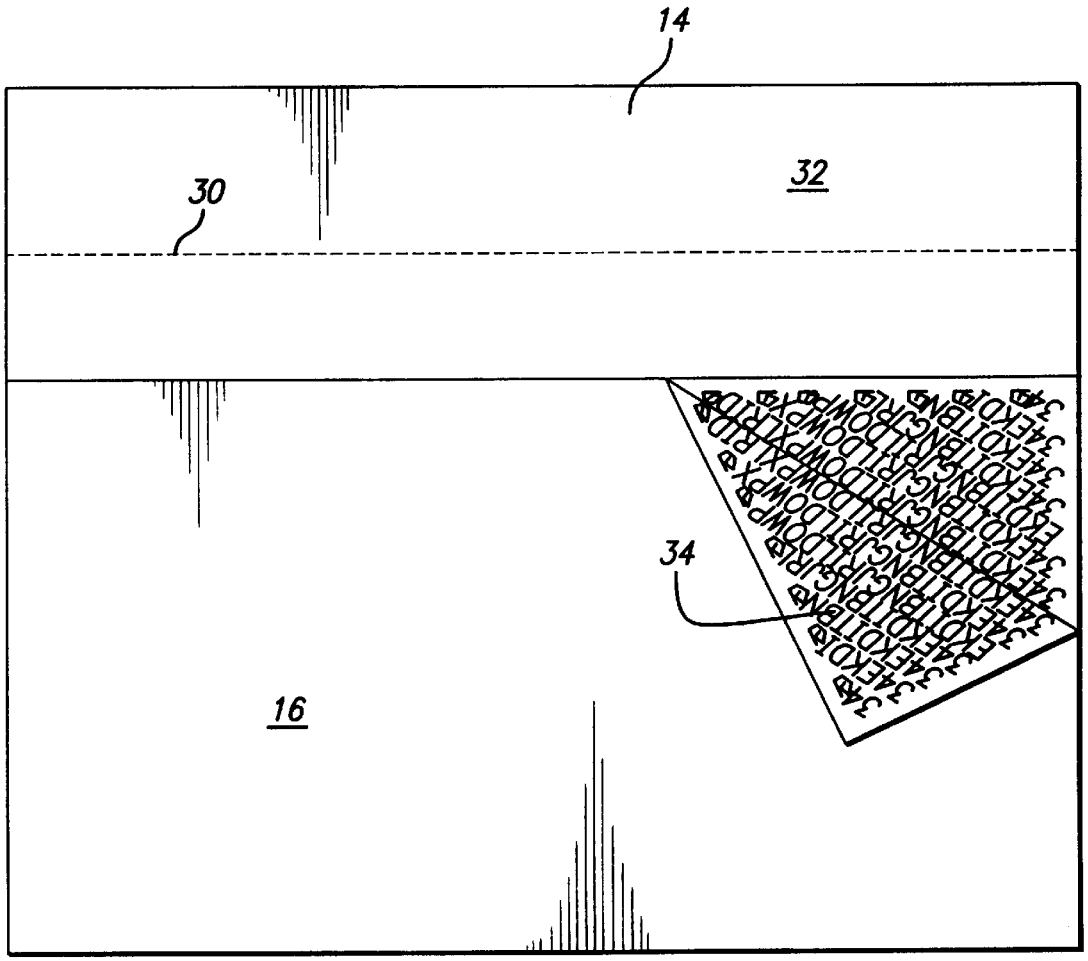
FIG. 5 shows a full two layer sheet assembly with the envelope partially pulled open.

In FIG. 5, one corner 34 of the envelope pocket has been pulled down, exposing the printed pattern on the inside of the layer. For easy printing using xerographic or ink jet printers, it is desirable that the two layer sheet assembly be relatively thin and flexible. As a result, the paper forming the front and back of the envelope may be semi-translucent or semi-transparent, so the printed pattern is useful to preclude reading of material enclosed within the envelope. By way of example, 20 pound paper may be used for each sheet of the two sheet assembly. When the term "20 pound paper" is used, it means that 500 sheets of paper 17 inches by 22 inches in size, weighs 20 pounds. Incidentally, while any pressure sensitive adhesive may be used, rubber based, hot melt permanent pressure sensitive adhesive is preferred.

Concerning dimensions, each of the sheets of the two layer envelope assembly may be 8½×11 inches, or A-4 size paper. The bottom and two sides of the envelope are bonded together by permanent adhesive, which may be the same pressure sensitive adhesive used on the sealing flap of the envelope. The envelopes are preferably 11 inches in length and between 4 and 5 inches, preferably about 4½ inches, in height. As an alternative, the envelopes may be made somewhat smaller in length by providing perforated tear-off portions at one end of the envelope area, and correspondingly shifting the glue or adhesive line; but the size of the envelope pocket should be maintained large enough to easily accommodate 8½×11 inches, or A-4 paper, folded three times. Thus, a height of at least 4 inches and a length of at least 9 inches for the envelopes is desired.

In conclusion, it is to be understood that the foregoing detailed description and accompanying drawings are illustrative of the principles of the invention. Various changes and modifications may be employed, for example, different sizes of paper such as 8½×14 inches, or other sizes and weights of paper may be employed, with envelope size being accordingly modified. Accordingly, the invention is not limited to the specific embodiments described and shown in the drawings.

What is claimed is:

1. An envelope sheet assembly for securing in a brochure or magazine or binder, or the like, comprising:

first and second sheets of paper overlying one another to form said assembly, and being of substantially uniform thickness for high speed printing on said envelope sheet assembly;

said envelope sheet assembly further including an envelope having a length greater than 8½ inches and a width greater than 4 inches for conveniently receiving a sheet 8½ inches by 11 inches, or an A-4 sheet folded three times;

a pressure sensitive adhesive coated strip forming the closure flap of said envelope, said flap being covered by a removable strip forming part of said envelope sheet assembly;

said two layer envelope sheet assembly being provided with perforations for permitting removal of said envelope from the rest of said two layer sheet assembly; and said envelope being sealed along the bottom and two sides thereof with permanent adhesive.

2. An envelope sheet assembly as defined in claim 1 wherein said envelope is approximately 11 inches long, and is between 4 and 5 inches in height.

3. An envelope sheet assembly as defined in claim 1 wherein each of the sheets making up said assembly is of lightweight semi-transparent paper, and wherein the inner surfaces of said envelope have a bold printed pattern to preclude reading material contained in said envelope.

4. An assembly as defined in claim 1 further comprising a brochure or binder into which the envelope sheet assembly is mounted, said brochure or binder having additional pages having substantially the same size as said envelope sheet assembly.

5. An assembly as defined in claim 4 wherein said envelope is formed at the outer edge of said envelope sheet assembly, extending outwardly from said brochure or binder.

6. An envelope sheet assembly as defined in claim 1 wherein said envelope sheet assembly has dimensions of substantially 8½ inches by 11 inches, or A-4 paper.

7. An envelope sheet assembly as defined in claim 1 further comprising an address printed on said envelope.

8. An envelope sheet assembly as defined in claim 1 wherein said envelope is sealed along the bottom and two sides thereof with permanent pressure sensitive adhesive.

9. An envelope sheet assembly for securing in a brochure or magazine or binder, or the like, comprising:

first and second sheets of paper overlying one another to form said assembly, and being of substantially uniform thickness for high speed printing on said envelope sheet assembly;

said envelope sheet assembly further including an envelope formed along an outer edge and at least one side of said envelope sheet assembly, and said envelope having dimensions substantially less than the dimensions of said envelope sheet assembly;

a pressure sensitive adhesive coated strip forming the closure flap of said envelope, said flap being covered by a removable strip forming part of said envelope sheet assembly;

said two layer envelope sheet assembly being provided with perforations for permitting removal of said envelope from the rest of said two layer sheet assembly; and said envelope being sealed with permanent adhesive.

10. An envelope sheet assembly as defined in claim 9 wherein said envelope is approximately 11 inches long, and is between 4 and 5 inches in height.

11. An envelope sheet assembly as defined in claim 9 wherein each of the sheets making up said assembly is of lightweight semi-transparent paper, and wherein the inner surfaces of said envelope have a bold printed pattern to preclude reading material contained in said envelope.

12. An envelope sheet assembly as defined in claim 9 further comprising a brochure or binder into which the envelope sheet assembly is mounted, said brochure or binder having additional pages having substantially the same size as said envelope sheet assembly.

13. An envelope sheet assembly as defined in claim 9 wherein said envelope is formed at the outer edge of said envelope sheet assembly, extending outwardly from said brochure or binder.

14. An envelope sheet assembly as defined in claim 9 wherein said envelope sheet assembly has dimensions of substantially 8½ inches by 11 inches, or A-4 paper.

15. An envelope sheet assembly as defined in claim 9 further comprising an address printed on said envelope.

16. An envelope sheet assembly as defined in claim 9 wherein said envelope is sealed along the bottom and two sides thereof with permanent pressure sensitive adhesive.

17. A combination including an envelope sheet assembly for securing in a brochure or magazine or binder, or the like, comprising:

first and second sheets of paper overlying one another, to form said assembly, and being of substantially uniform thickness for high speed printing on said envelope sheet assembly;

said envelope sheet assembly further including an envelope formed along an outer edge and at least one side of said envelope sheet assembly, and said envelope having dimensions substantially less than the dimensions of said envelope sheet assembly;

a pressure sensitive adhesive coated strip forming the closure flap of said envelope, said flap being covered by a removable strip forming part of said return envelope sheet assembly;

said two layer return envelope sheet assembly being provided with perforations for permitting removal of said envelope from the rest of said two layer sheet assembly;

said envelope being sealed with permanent adhesive; and a brochure or binder into which the envelope sheet assembly is mounted, said brochure or binder having additional pages having substantially the same size as said envelope sheet assembly.

18. An envelope sheet assembly as defined in claim 17 wherein said envelope is approximately 11 inches long, and is between 4 and 5 inches in height.

19. An envelope sheet assembly as defined in claim 17 wherein each of the sheets making up said assembly is of lightweight semi-transparent paper, and wherein the inner surfaces of said envelope have a bold printed pattern to preclude reading material contained in said envelope.

20. An envelope sheet assembly as defined in claim 17 wherein said envelope sheet assembly has dimensions of substantially ½ inches by 11 inches, or A-4 paper.

* * * * *